US006070625A

United States Patent [19]

Robinson et al.

[11] Patent Number: 6,070,625

[45] Date of Patent: Jun. 6, 2000

[54] GAS PUMP LEVER HOLDER

[76] Inventors: Royce F. Robinson; Josette D. Robinson, both of P.O. Box 670744, Houston, Tex. 77267-0744

[21] Appl. No.: 09/136,808

[22] Filed: Aug. 19, 1998

[51] Int. Cl.[7] ..... B65B 1/04

[52] U.S. Cl. ..... 141/392; 251/90; 74/526

[58] Field of Search ..... 141/392; 251/90, 251/92, 115; 74/526

[56] References Cited

U.S. PATENT DOCUMENTS

| | | | |
|---|---|---|---|
| D. 299,112 | 12/1988 | Downcy | D8/354 |
| D. 326,462 | 5/1992 | Cooper | 141/392 |
| D. 333,605 | 3/1993 | Powell, Jr. | D8/349 |
| D. 357,399 | 4/1995 | Miller | D8/354 |
| 4,175,595 | 11/1979 | Noe | 141/1 |
| 4,200,128 | 4/1980 | Pokrzywa | 141/392 |
| 4,201,253 | 5/1980 | Maloney | 141/392 |
| 4,210,181 | 7/1980 | Clevenger | 141/392 |
| 4,278,116 | 7/1981 | Opp | 141/392 |
| 4,334,560 | 6/1982 | Lockwood | 141/392 |
| 4,337,917 | 7/1982 | Tesack et al. | 251/90 |
| 4,690,182 | 9/1987 | Knaus | 141/392 |
| 5,118,074 | 6/1992 | Weissman | 251/90 |
| 5,217,054 | 6/1993 | Mollica | 141/391 |
| 5,240,226 | 8/1993 | Bobst | 251/90 |

*Primary Examiner*—Henry J. Recia
*Assistant Examiner*—Khoa Huynh

[57] ABSTRACT

A brace has been invented for releasably maintaining a control lever of a gasoline pump apparatus in a selected position, the brace, in certain aspects, having a body member, at least two pairs of spaced-apart opposed separation members on the body member, including at least a first pair and a second pair, the first pair spaced-apart a first distance and the second pair spaced-apart a second distance which is different from the first distance. In another aspect the brace has a hole through the body member; and in certain aspects, an item is releasably disposed through the hole in the body member. In other aspects one or more channels between two of the separation members facilitates flexing of the body member. In another aspect, a brace has been invented which has a first part, a second part, a spring having a core portion, a first end connected to the first part, and a second end connected to the second part, and the spring urging the two parts to move together rotating about the spring's core portion. A strap, chain, or other connector may be connected to or formed integrally of the device so that it is connectable to a part of an automobile, e.g. near the gas tank inlet or the door covering it, so that a user will have it readily available and to prevent loss of the device.

5 Claims, 8 Drawing Sheets

FIG. 13C
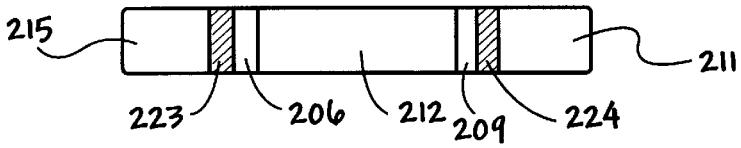
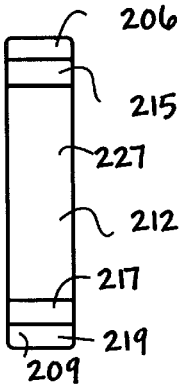
FIG. 13B
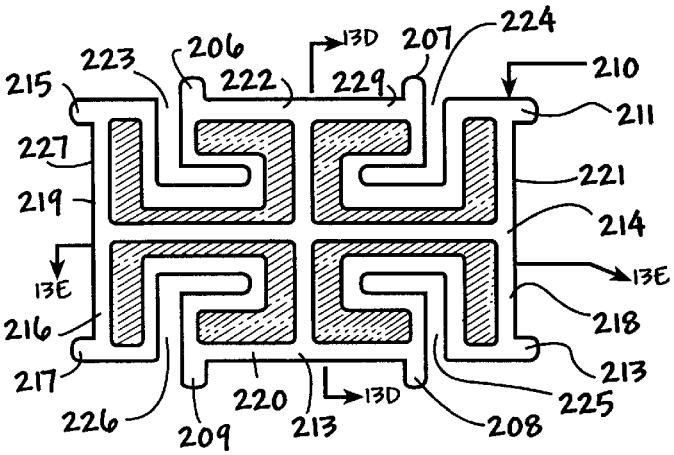
FIG. 13A
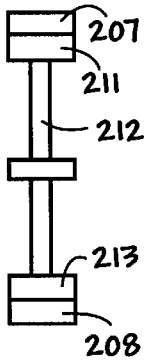
FIG. 13D
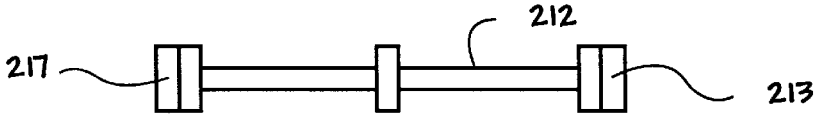
FIG. 13E
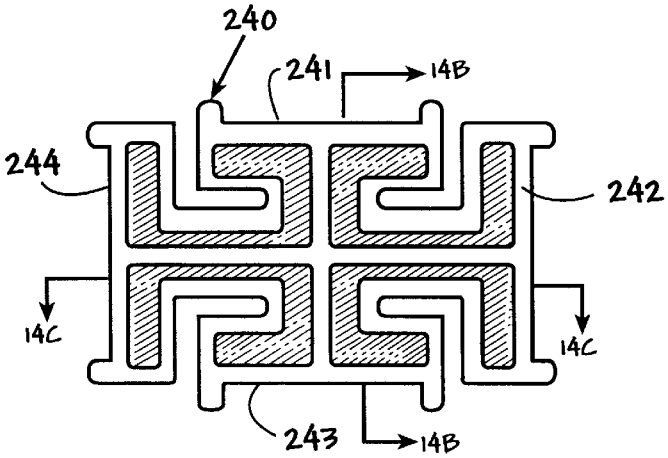
FIG. 14A
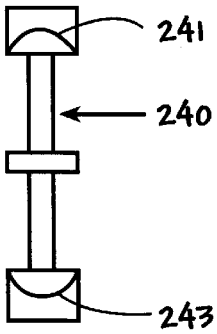
FIG. 14B
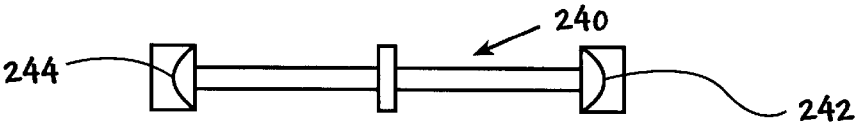
FIG. 14C

GAS PUMP LEVER HOLDER

BACKGROUND OF THE INVENTION

1. Field of the Invention

This invention is directed to holders and braces for releasably maintaining a gasoline pump lever in a selected position for pumping gasoline.

2. Description of Related Art

U.S. Pat. No. 4,175,595 discloses a gasoline flow control device for regulating the flow of gasoline through a gasoline pump handle having a body with an upper and a lower spaced-apart surface thereon, the upper surface having a plurality of steps therein varying in distance from the lower surface on the body. Each step on the upper surface is concave in configuration and the lower surface includes a plurality of ridges and valleys cut therein forming an irregular surface thereon.

U.S. Pat. No. 4,200,128 discloses a fuel valve actuator hold open lock with a formed member insertable into an opening in a trigger guard in a gasoline pump delivery valve assembly, the member having longitudinally spaced apart abutment shoulders for engaging the valve actuating trigger.

U.S. Pat. No. 4,201,253 discloses a gas pump lever blocking member including an elongated member with a first end adapted to engage the lever and a second end adapted to engage the lever guard in a plurality of positions corresponding to varying gas flow rates through the pump. The elongated member has a stepped portion proximate its second end defining a plurality of guard engagement surfaces lying in planes disposed along an elongation axis of the member.

U.S. Pat. No. 4,334,560 discloses a portable brace adjustable in length for retaining the trigger lever of a fuel dispensing nozzle in the open position and capable of easily disengaging in response to the shutoff actuating means of the nozzle.

U.S. Pat. No. 4,337,917 discloses a device that fits on a gasoline pump nozzle handle for holding the valve open, instead the need of continuously squeezing the handle in a hand; the device, in one design, including a collapsible brace for pressing against the handle.

U.S. Pat. No. 4,690,182 discloses a device to hold the lever of a nozzle assembly in a position to open a valve controlling the flow of fuel from the nozzle, e.g. a gasoline delivery nozzle assembly at a self-serve gasoline station.

U.S. Pat. No. 5,217,054 discloses an actuator for an automatic nozzle of a gasoline pump, the nozzle having a trigger operable within a housing which includes a trigger guard; the actuator having a spring member extending transversely of and supported on the trigger guard and engaging the trigger.

U.S. Pat. No. 5,240,226 discloses a fuel dispenser aid holding a trigger-like valve operating lever relative to a pistol grip-like handle portion of a valving device for dispensing gasoline or other fuels through a nozzle of the valving device without continuously manually holding the operating lever. The dispenser aid includes a mounting member formed of a material having a resilient, shape retaining character configured for mounting over the piston grip-like handle portion of the valving device, a flexible strap secured at a first end thereof to the mounting member and extending freely therefrom so that it can be looped under the trigger-like valve operating lever and up to the mounting member and an arrangement for releasably and adjustably fastening the free portion of the strap to the mounting member.

U.S. Pat. No. D 299,112 discloses a design for a brace for holding a gas pump nozzle in open position.

U.S. Pat. No. D 333,605 discloses a design for a gas pump nozzle trigger holder.

U.S. Pat. No. D 357,399 discloses a design for a combined gas pump nozzle lever holder and magnet.

SUMMARY OF THE PRESENT INVENTION

The present invention, in certain embodiments, discloses a brace for releasably maintaining a gasoline pump lever in a selected position, the lever associated with a nozzle, flow line and pump, so that gasoline flows while the brace is in place without the need for manually holding the lever. In one aspect such a brace has a body with one or more pairs of opposed spaced apart recesses or indentations for releasably receiving and holding the lever at one end and a portion of a handle or other member at the other end. In certain preferred embodiments, cut out areas between recesses facilitate flexibility of the device. In one aspect the body has a hole therethrough in which is releasably or permanently disposed an item such as, but not limited to, an air gauge, a magnifying lens, a compass, lipstick, a magnet, a pen or pencil, or coins for tolls.

In certain embodiments art work and/or advertising indicia is provided on the body of the brace. In one aspect a clear plastic or glass window overlies such art work or advertising indicia, including but not limited to, a photograph or a business card.

In other embodiments the body includes two separate tubular pieces, one insertable into and movably disposed with respect to the other. The movement of the pieces is governed by friction therebetween so that when an automatic shutoff is activated, the force of the lever overcomes the frictional contact between the two members. Thus during pumping the brace holds the lever in a pumping position and, at shut-off, the brace allows the lever to move to a shut-off position. In one aspect a spring may be used within the tubular members instead of or in addition to the frictional contact therebetween. In certain aspects, the brace is sized and configured so that when a lever is automatically moved to shut down gas flow, the brace itself flexes and/or releases so that this automatic function is not impeded.

In certain embodiments multiple pairs of opposed separation members provide a brace which is usable with gas pump apparatuses with different dimensions and/or with the capability to maintain a lever for either slower or faster pumping of gasoline.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

- New, useful, unique, efficient, nonobvious brace for releasably maintaining a gas pump lever in position during pumping of gasoline so that an operator need not manually hold the lever;
- Such a brace with multiple separation members for maintaining a gas pump lever in different positions and/or for accommodating different gas pump apparatuses;
- Such a brace that does not impede automatic pump shut-off;
- Such a brace with a hole therethrough for mounting an item therein releasably or permanently;

Such a brace with one or more rounded surfaces that abut parts of a pump handle so that when the pump automatically shuts off, release of the brace from a bracing position in or on the handle is facilitated;

Such a brace with a body that bears an ad, art, a photograph, or identifying indicia, and, in one aspect with a protective window overlying such things; and Such a brace which, in certain aspects, is a single-bodied member.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 13A is a front view of a brace according to the present invention. FIG. 13B is a side view of the brace of FIG. 13A. FIG. 13C is a top view of the brace of FIG. 13A. FIG. 13D is a view along line 13D—13D of FIG. 13A. FIG. 13E is a view along line 13E—13E of FIG. 13A.

FIG. 14A is a front view of a brace according to the present invention. FIG. 14B is a view along line 14B—14B of FIG. 14A. FIG. 14C is a view along line 14C—14C of FIG. 14A.

DESCRIPTION OF EMBODIMENTS PREFERRED AT THE TIME OF FILING FOR THIS PATENT

Figure 1C:
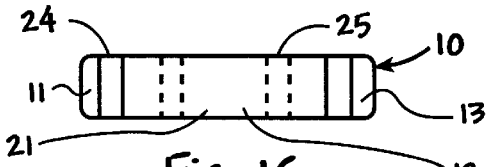
FIG. 1C is a top view and FIG. 1B is a bottom view of the brace of FIG. 1A.

Referring now to FIGS. 1A–1F, a brace 10 according to the present invention has a body 12 with two sets of spaced-apart opposed separation members 14, 16 and 20, 22. The member 14 of the body 12 has an end 18 and lips 11, 13 which define a recess 21 therebetween for releasably receiving a control lever of a gasoline pumping apparatus (or, alternatively, a part of the apparatus opposite the lever). The member 16 has an end 19 and lips 15, 17 which define a similar recess 27.

End recesses 28, 29 of spaced-apart opposed separation members 20, 22 are like the recesses 21, 27. Lips 8 and 9 define the recess 28 and lips 6, 7, define the recess 29.

Channels 23–26 through the body 12 facilitate flexing of the body 12 for emplacement in and removal from a gas pump apparatus; in one aspect provide sufficient flexibility so that movement of an automatically moved lever to shut/off gas flow is not impeded and also provide flexibility for accommodating apparatuses with slightly different dimensions.

Figure 1A:
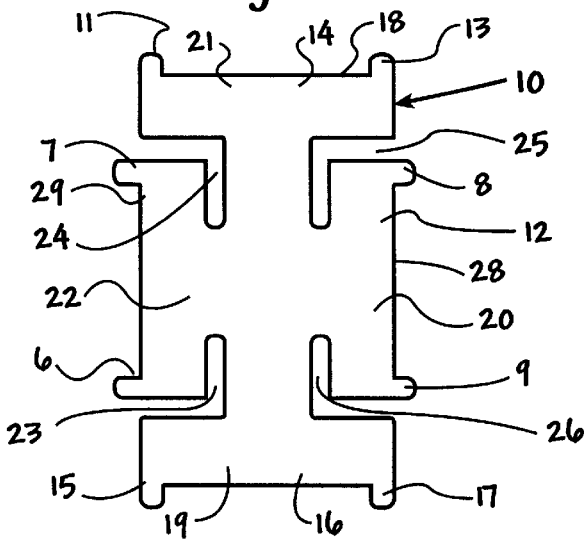
FIG. 1A is a front view of a brace according to the present invention.
Figure 1B:
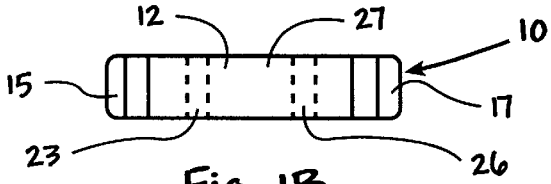
Figure 1D:
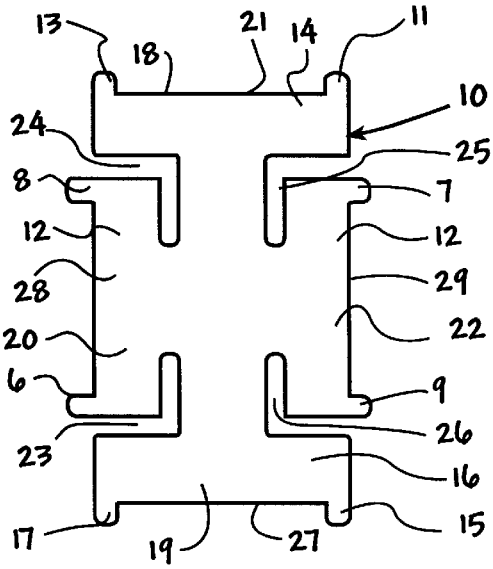
FIG. 1D is a rear view of the brace of FIG. 1A.
Figure 1E:
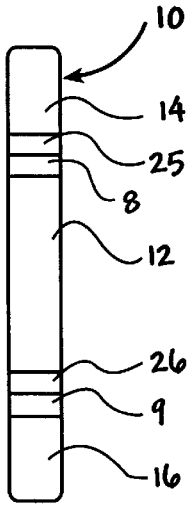
FIGS. 1E and 1F are side views of the brace of FIG. 1A.
Figure 1F:
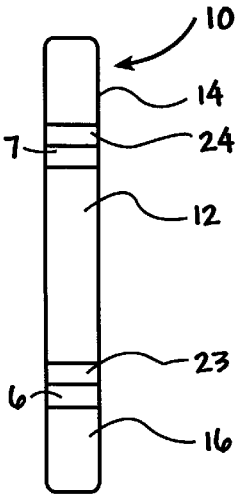
Figure 2B:
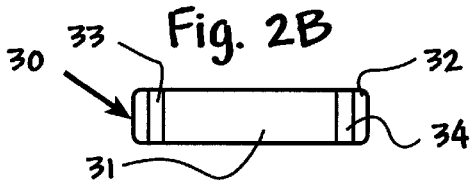
FIG. 2C is a top view and FIG. 2B is a bottom view of the brace of FIG. 2A.
Figure 2A:
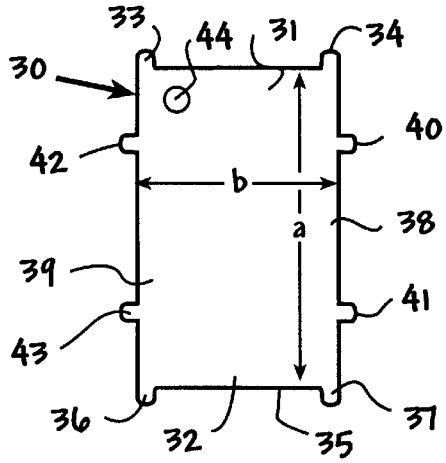
FIG. 2A is a front view of a brace according to the present invention.
Figure 2C:
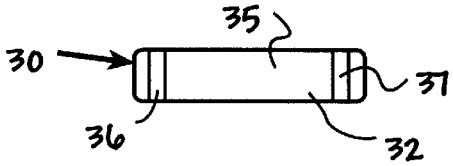
Figure 2D:
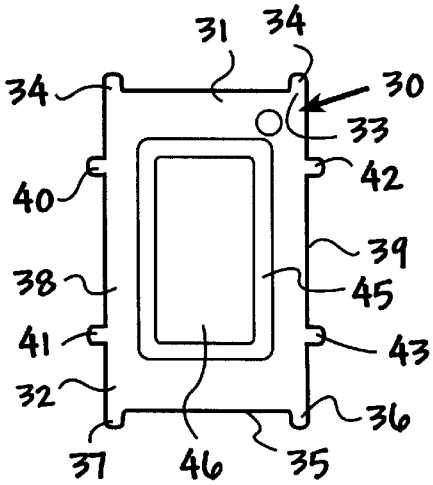
FIG. 2D is a rear view of the brace of FIG. 2A.
Figure 2E:
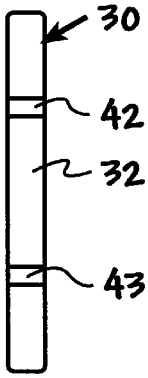
FIGS. 2E and 2F are side views of the brace of FIG. 2A.
Figure 2F:
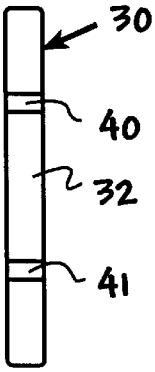

FIGS. 2A–2E show a brace 30 according to the present invention with a body 32 having opposed end recesses 31, 35 (like the recesses 21, 27 of FIG. 1A). The recess 31 is defined by lips 33, 34 and the recess 35 is defined by lips 36, 37. The body 32 also has opposed side recesses 38, 39 (like the recesses 38, 39, FIG. 1A). Lips 40, 41 define the recess 38 and lips 42, 43 define the recess 39. A hole 44 extends through the body, e.g. for connection to a ring or key chain and/or for connecting (in one aspect releasably) the device to a part of a car, e.g, but not limited to a part near the gasoline input, e.g. to the door that covers the gas tank input or to a point on the car body near the input. For such connection, any suitable strap, wire, chain, etc. may be used—either a separate item or formed integrally of the device body. A hole as the hole 44 or any suitable hole may be used with any embodiment of this invention As shown in FIG. 2D, a clear window 45 is secured to the body 12 so that an item, e.g., photo, art work, advertising material, spare car key, or business card 46 is removably emplaceable between the window 45 and body 12. The distance a between recesses 31 and 35 may be the same as the distance b between the recesses 38 and 39; but as shown in the embodiment of FIG. 2A these distances may be different.

Figure 3A:
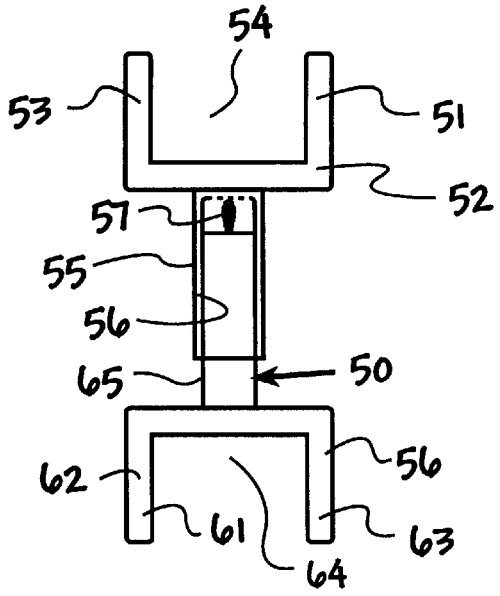
FIG. 3A is a front view of a brace according to the present invention.
Figure 3C:
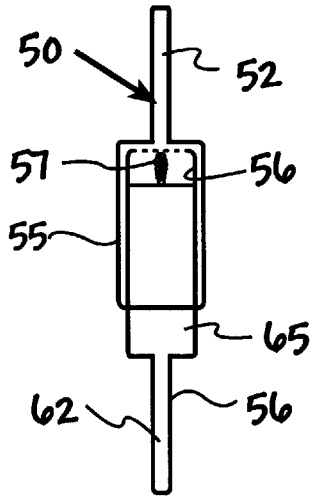
FIG. 3C is a side view of the brace of FIG. 3A.
Figure 3B:
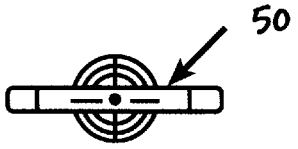
FIG. 3B is a top view of the brace of FIG. 3A.

FIGS. 3A–3C show a brace 50 according to the present invention with two parts 52 and 26. The part 52 has upper opposed arms 51, 53 which define a lever-receiving recess 54 therebetween. The part 52 has a tube 55 (of any desired cross-section, shape, including but not limited to, circular, oval, triangular, square, rectangular or hexagonal). The tube 55 has an inner channel 56 in which is disposed an optional spring 57.

The part 62 has a tube (solid or hollow) 65 and lower opposed arms 61, 63 which define a member-receiving recess 64. The recess 54 may be used to releasably hold a gas pump control lever and the recess 64 may be used for releasable emplacement about a part of the gas pump apparatus (e.g. a handle part) below the control lever, or vice versa.

A friction fit between the parts 52, 62 (between the inner surface of the tube 55 and the outer surface of the tube 65 may be sufficient to maintain the parts 52, 62 in a desired spaced-apart relation while the brace 50 is in place in a gas pump apparatus maintaining a control lever in an operative position; and the frictional force between the two parts 52, 62 is overcome when the pump's automatic shut-off is activated, moving the lever so that it moves the two parts 52, 62 together—i.e., the friction fit of the parts is such that it does not impede automatic shut-off of the pump. Alternatively (or in addition to the friction fit just described) a spring 57 may be used that abuts the part 52 and a top end 66 of the tube 65 to urge the parts apart, thus facilitating emplacement of the brace 50 in a gas pump apparatus and allowing for the accommodation of pumps apparatuses different dimensions.

Figure 3D:
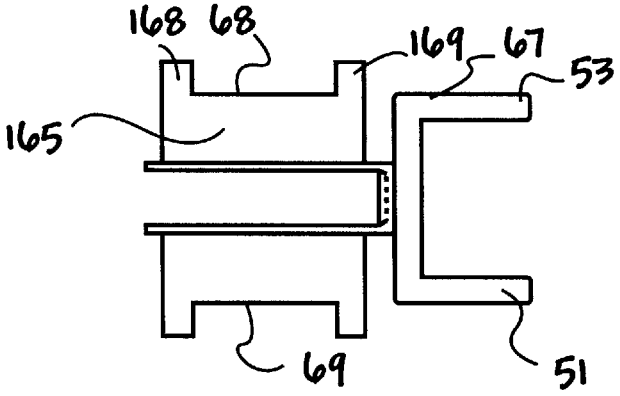
FIG. 3D is an alternative embodiment of one of the parts of the brace of FIG. 3A.

FIG. 3D shows an alternative to the part 52, a part 67 which has some structure like that of part 52 with the same identifying numerals. Part 67 also has opposed side recesses 68, 69 defined by lips 168, 169 which surround a tube 165.

Figure 4:
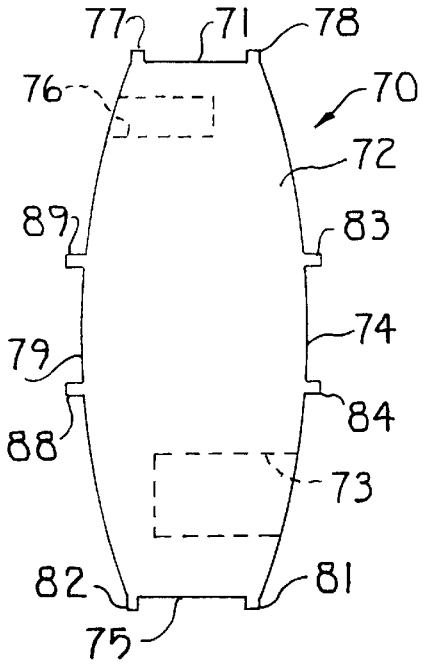
FIG. 4 is a front view of a brace according to the present invention.

FIG. 4 shows a brace 70 according to the present invention with a body 32 having opposed end recesses 71, 75 (like the recesses 21, 27 of FIG. 1A). The recess 71 is defined by lips 77, 78 and the recess 75 is defined by lips 81, 82. The body 72 also has opposed side recesses 74, 79 (like the recesses 38, 39, FIG. 1A). Lips 88, 89 define the recess 79 and lips 83, 84 define the recess 75. Holes 76 and 73 extends into the body 72, holes and body sized as desired to releasably hold a part or all of an item such as, but not limited to, a pencil, pen, lipstick, magnet, air gauge, sunglasses. Any embodiment herein may have such a hole. Also, one of the sets of opposed recesses may be deleted.

Figure 5:
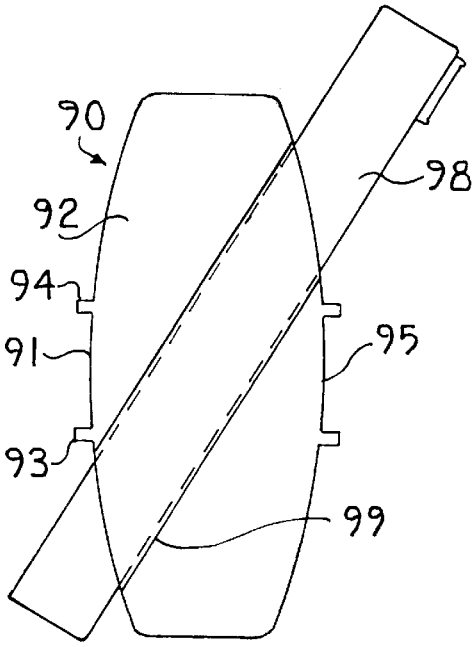
FIG. 5 is a front view of a brace according to the present invention.

FIG. 5 shows a brace 90 according to the present invention with a cylindrical body 92 having opposed recesses 91, 95 (like the recesses 21, 27 of FIG. 1A). The recess 91 is defined by lips 93, 94 which surround the body 92 and define recess 95. A hole 99 may be oriented in any desired direction and located anywhere through the body 92. An air gauge 98 is removably held in the hole 99. Any of the items listed above (in brace 70) may be in the hole 99. Alternatively another set of end recesses may be provided on the top and bottom (as viewed in FIG. 5) of the body 92.

Figure 6A:
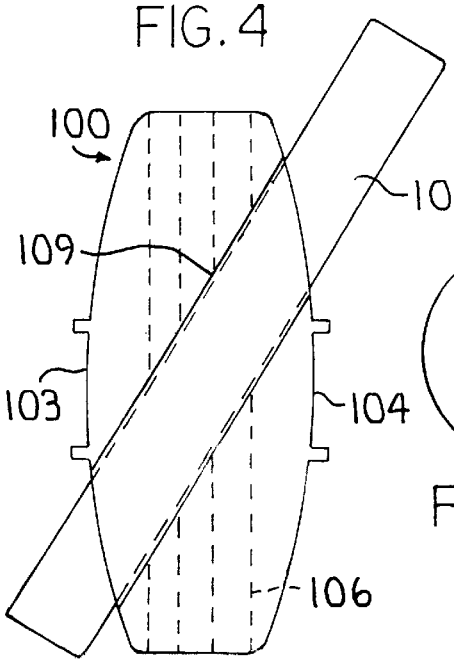
FIG. 6A is a front view of a brace according to the present invention.
Figure 6B:
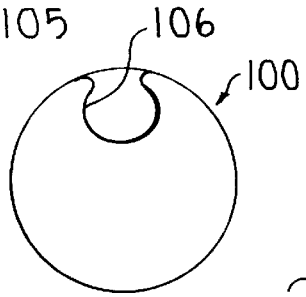
FIG. 6B is a cross-section view of the brace of FIG. 6A.

FIGS. 6A and 6B show a brace 100 according to the present invention, like the brace 90 and having recesses 103, 104 (like the recesses 93, 94); a hole 109 (like the hole 99); and an item 105 (like the item in the brace 70 or air gauge 98). A groove 106 through the body 102 is designed, disposed, and configured to releasably snap onto another member such as, but not limited to, a part of an automobile (e.g. door handle, knobs, visor, rear view mirror, gas cap edge, ridge on a gas cap or portion thereof), of a cellular phone, of a note pad, or of a purse. Alternatively, the groove can hold any item, e.g. but not limited to those items described as emplaceable in the hole 99 (FIG. 5) or the hole 109 (FIG. 6A).

Figure 7:
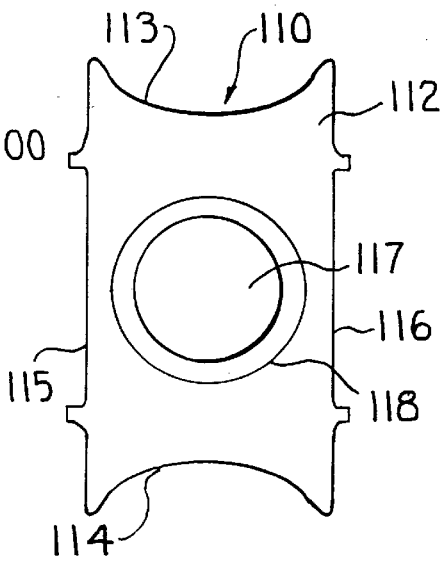
FIG. 7 is a front view of a brace according to the present invention.

FIG. 7 shows a brace 110 according to the present invention with a body 112 having spaced apart end recesses 113, 114 and spaced-apart side recesses 115, 116. A lens 117 is secured in a hole 118 through the body 112. The lens 117 may be a magnifying lens. Such a hole and lens may be provided on any embodiment disclosed herein. Also, the concave recesses as shown for the brace 110 may be used instead of any of the recesses described for any other embodiment herein.

Figure 8A:
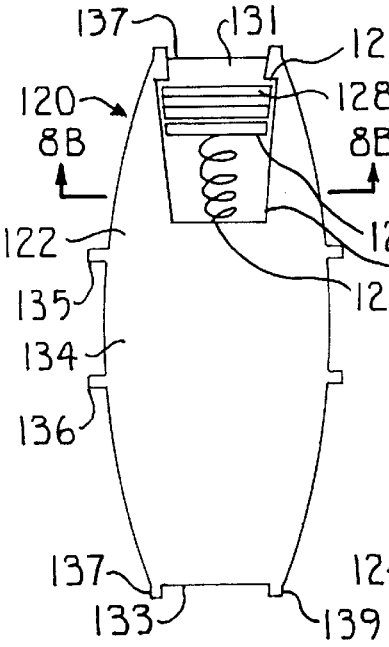
FIG. 8A is a front view of a brace according to the present invention.
Figure 8B:
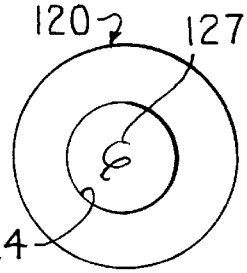
FIG. 8B is a cross-sectional view of the brace of FIG. 8A.

A brace 120 as shown in FIG. 8A is like the brace 70 of FIG. 4A but has a body 122 with a hole 124 therein in which is movably mounted a plate 126 urged outwardly by a spring 127 to abut a shoulder 125 of the body 122. Coins 128 are removably disposed in the hole 124. Recesses 131, 133 are like the recesses 171, 173 (FIG. 4A) with lips 137 and 139 respectively; and recess 134 has an upper lip 135 and a lower lip 136 around the body 122. A coin-holding hole as here described may be provided on any embodiment of this invention and, in such embodiments, the body is sized to accommodate such a hole.

Figure 9:
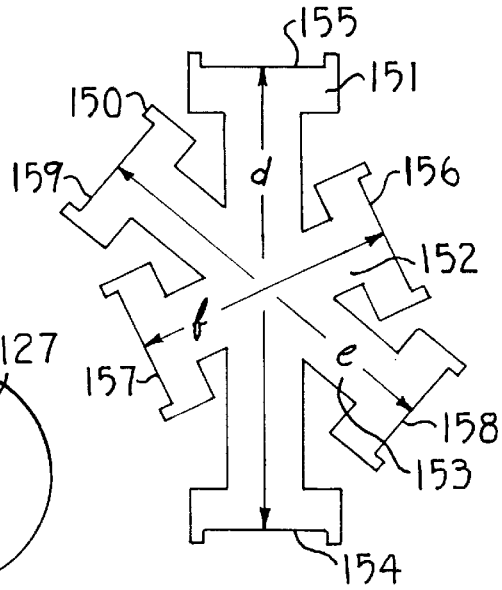
FIG. 9 is a front view of a brace according to the present invention.

FIG. 9 discloses a brace 150 with a thickness like the brace of FIG. 1A, but with three spacing members 151, 152, 153 each having a pair of opposed spaced-apart end recesses 154, 155; 156, 157; and 158, 159; respectively. Distances d, e, f are all different.

Figure 10A:
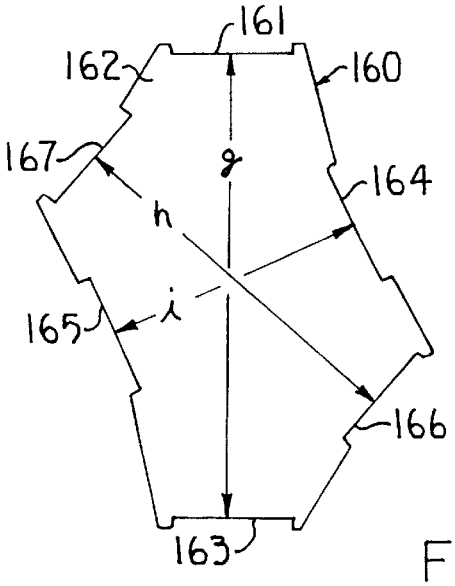
FIG. 10A is a front view of a brace according to the present invention.
Figure 10B:
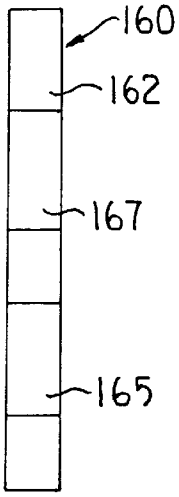
FIG. 10B is a side view of the brace of FIG. 10A.

FIGS. 10A and 10B show a brace 160 with a body 162 which is a single unitary piece having three sets of spaced apart recesses 161, 163; 164, 165; and 166, 167. The distances g, h, i are all different.

Figure 11:
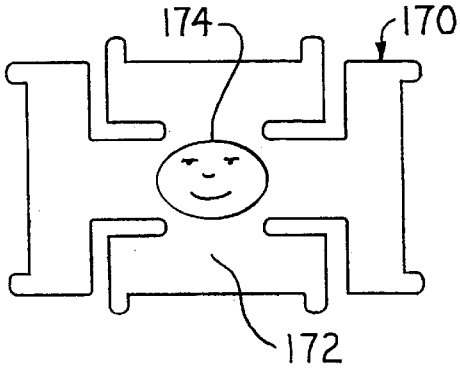
FIG. 11 is a front view of a brace according to the present invention.

FIG. 11 shows a brace 170 like the brace 10 with art work 174 on a body 172. The art work may be embossed into or applied on the body 172. Such art work may be sued with any embodiment described herein.

Figure 12A:
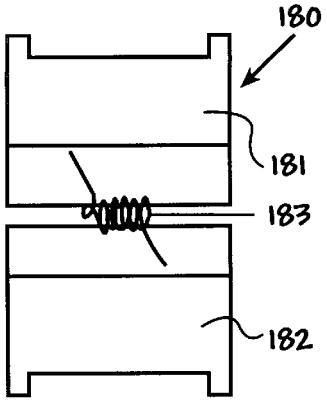
FIGS. 12A and 12B are a rear views of a brace according to the present invention.
Figure 12B:
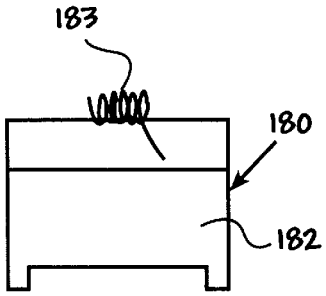
Figure 12C:
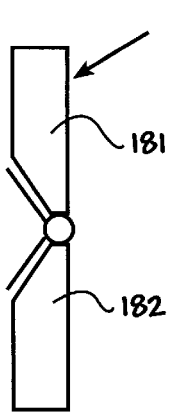
FIGS. 12C and 12D are side views of the brace of FIG. 12A.
Figure 12D:
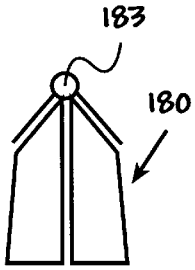
Figure 12E:
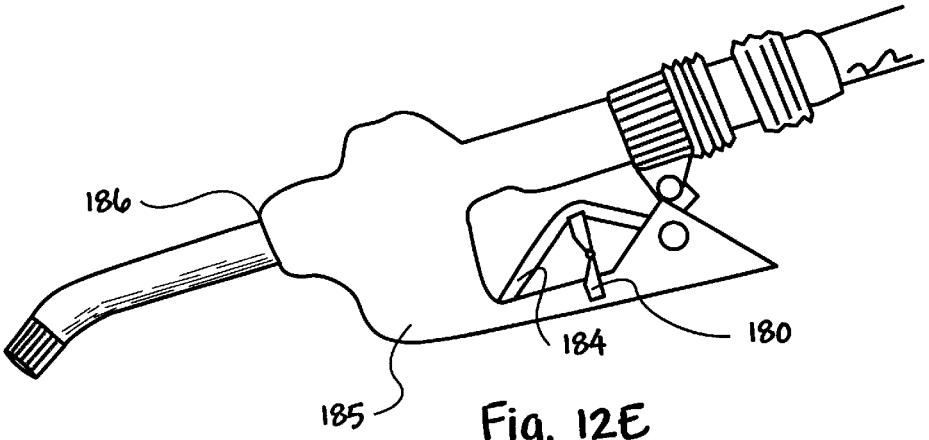
FIGS. 12E and 12F are side views of the brace of FIG. 12A with a gas pump apparatus.
Figure 12F:
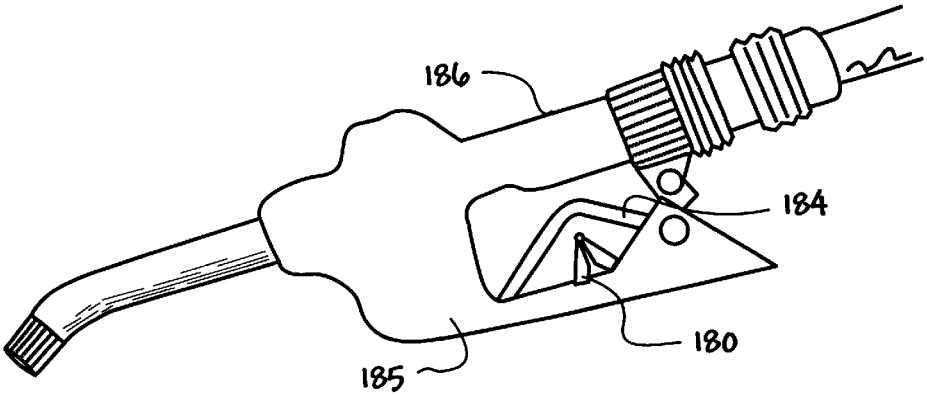

It is within the scope of the present invention for the braces of FIGS. 2A and 4–10A to be relatively rigid or to be made of material sufficiently flexible to hold a gas lever in pumping position and to flax (e.g. compress) so that pump automatic shut-off is not impeded. FIGS. 12A–12F show a brace 180 according to the present invention with two parts 181, 182 connected together by a spring 183 which tends to urge the two parts 181, 182 into the position shown in FIGS. 12D and 12F. As shown in FIGS. 12A and 12E, with the two parts 181, 182 held apart by a pump lever 184 of a handle 185 of a gas nozzle mechanism 186, the spring's force is overcome. In FIGS. 12B and 12F, when the lever 184 is moved automatically to stop gas flow, the lever force on the brace is released and the spring force moves the brace parts together.

Referring now to FIGS. 13A–13E and 15A–15D, a brace 210 according to the present invention has a body 212 with two sets of spaced-apart opposed separation members 214, 216 and 220, 222. The member 214 of the body 212 has an end 218 and lips 211, 213 which define a recess 221 therebetween for releasably receiving a control lever of a gasoline pumping apparatus (or, alternatively, a part of the apparatus opposite the lever). The member 216 has an end 219 and lips 215, 217 which define a similar recess 227.

End recesses 228, 229 of spaced-apart opposed separation members 220, 222 are like the recesses 221, 227. Lips 208 and 209 define the recess 228 and lips 206, 207, define the recess 229.

Figure 15A:
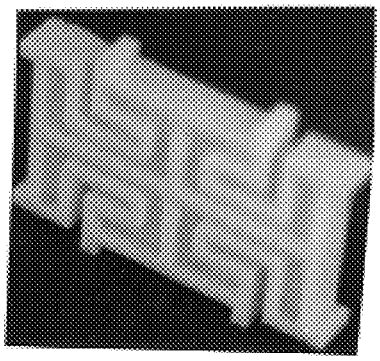
FIG. 15A is a perspective view of a brace as in FIG. 13A.
Figure 15B:
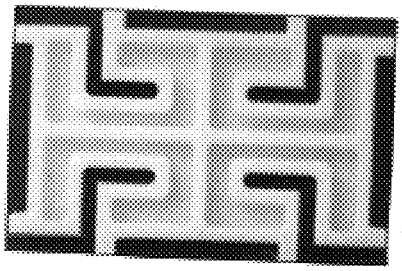
FIG. 15B is a front view of the brace of FIG. 15A.
Figure 15C:
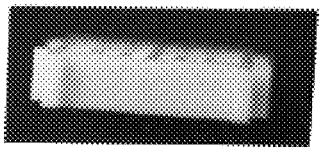
FIG. 15C is a side view of the brace of FIG. 15A.
Figure 15D:
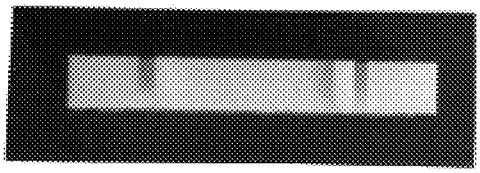
FIG. 15D is an top view of the brace of FIG. 15A.

Channels 223–226 extend through the body 212 and there are four grooves 230 in each side of the body. The rear view (not shown) of the body 212 is like the front view of FIGS. 13A and FIG. 15B. The side opposite the side shown in FIG. 13B and FIG. 15C is like the side shown in FIG. 13B and FIG. 15C. The bottom (not shown) is like the top shown in FIGS. 13C and 15D.

FIGS. 14A–14C show a brace 240 like that of FIGS. 13A–13E and 15A–15D, but surfaces 241–244 are rounded to facilitate release of the brace from a pump apparatus. Such release is facilitated when the brace is removed manually or when the pump automatically stops and the stopping action itself moves the brace releasing it or "pops" it free due to the rounded surfaces. Although this can also occur with the brace of FIG. 13A, such occurrence is facilitated with the rounded surfaces.

The present invention, therefore, in certain embodiments, provides a brace for releasably maintaining a control lever of a gasoline pump apparatus in a selected position, the brace having a body member, and at least two pairs of spaced-apart opposed separation members on the body member, including at least a first pair and a second pair, the first pair spaced-apart a first distance and the second pair spaced-apart a second distance which is different from the first distance; such a brace wherein each separation member has a recess between spaced-apart lips for releasably holding another member; such a brace wherein the at least two pairs of spaced-apart members is three pairs of spaced-apart members; such a brace with a hole through the body member; such a brace with an item releasably disposed through the hole in the body member; such a brace with a plate movably mounted within the hole and urged outwardly by a spring, and an inner lip around the hole for releasably retaining at least one coin on the plate within the hole; such a brace with a transparent piece secured to the body member and beneath which is emplaceable a thin item (e.g. but not limited to a photo, an ad, or calling card viewable through the transparent piece); such a brace wherein the body member has a first part and a second part, the first part having a portion disposed within and movable within a portion of the second part; such a brace with a spring within the body member biasing apart the first part and the second part; such a brace with a plurality of one or more channels between at least two members of the at least two pairs of spaced-apart opposed separation members for facilitating flexing of the body member; and/or such a brace with a groove in the body member permitting the brace to be releasably snapped onto another member; and/or any such brace (and any brace disclosed herein) with one or more, and at least one, rounded surface on a separation member for facilitating removal and/or release of a brace from a pump apparatus, and, in one aspect, to facilitate release of such a brace from a pump apparatus when an automatic stop function is activated.

The present invention, therefore, provides, in certain aspects, a brace for releasably maintaining a control lever of a gasoline pump apparatus in a selected position, the brace having a body member, at least two pairs of spaced-apart opposed separation members on the body member, including at least a first pair and a second pair, the first pair spaced-apart a first distance and the second pair spaced-apart a second distance which is different from the first distance; such a brace wherein each separation member has a recess between spaced-apart lips for releasably holding another member; any such brace wherein the at least two pairs of spaced-apart members is three pairs of spaced-apart members; any such brace with a hole through the body member; any such brace with an item permanently or releasably disposed through the hole in the body member and/or with a connector therethrough for connecting the device to a part of a car; any such brace wherein the item is a lens; any such brace with a plate movably mounted within the hole and urged outwardly by a spring, and an inner lip around the hole for releasably retaining at least one coin on the plate within the hole; any such brace with a transparent piece secured to the body member and beneath which is emplaceable a thin item; any such brace wherein the body member has a first part and a second part, the first part having a portion disposed within and movable within a portion of the second part; any such brace with a spring within the body member biasing apart the first part and the second part; any such brace with one or with a plurality of channels between the at least two pairs of spaced-apart opposed separation members for facilitating flexing of the body member; and any such brace a groove in the body member permitting the brace to be releasably snapped onto another member.

The present invention, therefore, in certain embodiments, provides a brace for releasably maintaining a control lever of a gasoline pump apparatus in a selected position, the brace having a body member, at least two pairs of spaced-apart opposed separation members on the body member, including at least a first pair and a second pair, the first pair spaced-apart a first distance and the second pair spaced-apart a second distance which is different from the first distance, each separation member having a recess between spaced-apart lips for releasably holding another member, and a plurality of channels between the at least two pairs of spaced-apart opposed separation members for facilitating flexing of the body member; such a brace with a hole through the body member; such a brace of claim 14 with an item releasably disposed through the hole in the body member; such a brace with a transparent piece secured to the body member and beneath which is emplaceable a thin item; such a brace wherein the body member has a first part and a second part, the first part having a portion disposed within and movable within a portion of the second part; and such a brace with a spring within the body member biasing apart the first part and the second part.

The present invention, therefore, provides, in certain aspects, a brace for releasably maintaining a control lever of a gasoline pump apparatus in a selected position, the brace having a first part, a second part, a spring having a core portion, a first end connected to the first part, and a second end connected to the second part, and the spring urging the two parts to move together rotating about the spring's core portion when the brace is freed from a position holding the lever; and such a brace wherein each of the first part and second part has an outer end with an open recess defined by spaced-apart lips for facilitating maintenance of the brace on the gasoline pump apparatus.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventor may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A brace for releasably maintaining a control lever of a gasoline pump apparatus in a selected position, the brace comprising a body member, at least two pairs of spaced-apart opposed separation members on the body member, including at least a first pair and a second pair, the first pair spaced-apart a first distance and the second pair spaced-apart a second distance which is different from the first distance; and a plurality of channels between the at least two pairs of spaced-apart opposed separation members for facilitating flexing of the body member.

2. The brace of claim 1 wherein each separation member has a recess between spaced-apart lips for releasably holding another member.

3. The brace of claim 1 wherein at least one of the separation members has a rounded surface for facilitating release of the brace from a bracing position on the gasoline pump apparatus.

4. The brace of claim 1 further comprising a groove in the body member permitting the brace to be releasably snapped onto another member.

5. A brace for releasably maintaining a control lever of a gasoline pump apparatus in a selected position, the brace comprising a body member, at least two pairs of spaced-apart opposed separation members on the body member, including at least a first pair and a second pair, the first pair spaced-apart a first distance and the second pair spaced-apart a second distance which is different from the first distance, each separation member having a recess between spaced-apart lips for releasably holding another member, and a plurality of channels between the at least two pairs of spaced-apart opposed separation members for facilitating flexing of the body member.

* * * * *